US011085433B2

(12) United States Patent
Abel et al.

(10) Patent No.: US 11,085,433 B2
(45) Date of Patent: Aug. 10, 2021

(54) DIAPHRAGM PUMP

(71) Applicant: PSG Germany GmbH, Duisburg (DE)

(72) Inventors: Matthias Abel, Wesel (DE); Daniel Gisbertz, Bottrop (DE); Andreas Frerix, Xanten (DE); Praveen Chandrashekaraiah, Bangalore (IN); Gokilnathan Vasudevan, Pethanaickenpalayam (IN); Vasantha Kumar Raja, Chennai (IN)

(73) Assignee: PSG Germany GmbH, Duisburg (DE)

( * ) Notice: Subject to any disclaimer, the term of this patent is extended or adjusted under 35 U.S.C. 154(b) by 122 days.

(21) Appl. No.: 15/807,289

(22) Filed: Nov. 8, 2017

(65) Prior Publication Data

US 2018/0142684 A1 May 24, 2018

(30) Foreign Application Priority Data

Nov. 23, 2016 (EP) ..... 16002479

(51) Int. Cl.

| | |
|---|---|
| ***F04B 43/02*** | (2006.01) |
| ***F04B 53/10*** | (2006.01) |
| ***F04B 43/00*** | (2006.01) |
| *F04B 45/04* | (2006.01) |

(52) U.S. Cl.

CPC ..... *F04B 43/026* (2013.01); *F04B 43/0009* (2013.01); *F04B 43/0045* (2013.01); *F04B 53/1065* (2013.01); *F04B 53/1067* (2013.01); *F04B 53/1072* (2013.01); *F04B 45/043* (2013.01)

(58) Field of Classification Search

CPC .. F04B 53/1072; F04B 45/043; F04B 43/026; F04B 43/0045; F04B 53/1067; F04B 53/1065; F04B 43/02; F04B 43/0009; F04B 1/18; F04B 1/188; F04B 1/0465; F04B 53/1075

USPC ..... 417/567, 568

See application file for complete search history.

(56) References Cited

U.S. PATENT DOCUMENTS

| | | | | | |
|---|---|---|---|---|---|
| 2,213,256 | A * | 9/1940 | Paget | F04B 39/1033 | 417/562 |
| 2,407,792 | A * | 9/1946 | McMillan | F04B 43/0036 | 417/566 |
| 2,424,595 | A * | 7/1947 | Warren | F04B 43/0054 | 417/387 |
| 3,900,276 | A * | 8/1975 | Dilworth | F04B 53/1065 | 417/542 |

(Continued)

FOREIGN PATENT DOCUMENTS

| | | |
|---|---|---|
| DE | 10117531 A1 | 10/2002 |
| DE | 202006020237 U1 | 2/2008 |

(Continued)

*Primary Examiner* — Charles G Freay

(74) *Attorney, Agent, or Firm* — Howard IP Law Group, PC

(57) ABSTRACT

A diaphragm pump has at least one pump chamber, the pump chamber being connected to an inlet chamber via an inlet valve and to an outlet chamber via an outlet valve. The inlet valve has an inlet opening which can be closed by an inlet valve body, and the outlet valve has an outlet opening which can be closed by an outlet valve body. The outlet opening surrounds the inlet opening, or the inlet opening surrounds the outlet opening.

22 Claims, 6 Drawing Sheets

(56) References Cited

U.S. PATENT DOCUMENTS

| | | | | |
|---|---|---|---|---|
| 4,721,443 | A * | 1/1988 | Allen | F04B 39/1073<br>417/539 |
| 2004/0166006 | A1 * | 8/2004 | Bergman | F04B 39/1066<br>417/567 |
| 2005/0079081 | A1 * | 4/2005 | Nieter | F04B 39/1073<br>417/567 |

FOREIGN PATENT DOCUMENTS

| | | | |
|---|---|---|---|
| DE | 102008035592 | B4 | 10/2014 |
| GB | 440693 | A | 1/1936 |

* cited by examiner

DIAPHRAGM PUMP

CROSS-REFERENCE TO RELATED APPLICATIONS

This application claims priority pursuant to 35 U.S.C. 119(a)-(d) to European Patent Application No. 16 002 479.0 filed Nov. 23, 2016, the entire contents of which are incorporated herein by reference for all purposes.

FIELD OF THE INVENTION

The invention relates to a diaphragm pump with a pump chamber, the pump chamber being connected to an inlet chamber via an inlet channel and to an outlet chamber via an outlet channel.

BACKGROUND

DE 101 17 531 A1 and DE 20 2006 020 237 U1 disclose diaphragm pumps which have a pump head essentially connected to a drive. The pump head has multiple, for example, four pump chambers, each of which is sealed off from a drive chamber by means of a pump diaphragm. The respective pump diaphragm is thereby connected to a wobble plate arranged in the drive chamber via an associated pump element. In this case, a wobbling motion of the wobble plate enables the pump diaphragm to perform a wobbling, axially periodic pumping motion. The wobble plate is seated on a drive pin of a drive shaft connected to the drive. The drive pin is thereby inclined relative to the longitudinal axis of the drive shaft and is connected to the wobble plate via a ball bearing. In the diaphragm pump, according to DE 101 17 531 and DE 20 2006 020 237 U1, an outlet chamber is arranged centrically and an inlet chamber is arranged concentrically to the outlet chamber around the outlet chamber.

In a diaphragm pump known from DE 10 2008 035 592 B4, the inlet chamber is arranged centrally and the outlet chamber is arranged concentrically to the inlet chamber. The outlet chamber has an outlet channel at its vertically lower region, a valve plate having the pump chambers and valves being arranged between an intermediate plate part having the chambers and a diaphragm carrying part carrying the pump diaphragms, wherein an inlet valve plate having the inlet valves is arranged towards the pump chambers upstream of the inlet chamber of the intermediate plate part in a section of the valve plate.

Such pumps are used, in particular, in the areas of chemistry, pharmacy and biotechnology, in which the media to be conveyed are sometimes very expensive, so that it is desirable that after the pumping process, no or only a small residual volume of the pumped medium remains in the diaphragm pump. Furthermore, the complete filling of such diaphragm pumps with the fluid without air inclusions is advantageous for the conveying performance.

The diaphragm pumps known from DE 101 17 531 and DE 20 2006 020 237 U1 which in principal have proven to be successful, have proven to be disadvantageous in that they have a central inlet chamber which leads to the fact that a relatively large residual volume of the conveyed medium remains in the inlet chamber after completion of the pumping process because of the outer outlet chamber being arranged essentially concentrically to the inlet chamber. Furthermore, air frequently remains in upper pump chambers of the pump, which mostly affects the conveying stability (pulsation) as well as the pumping performance disadvantageously. A disadvantage of the diaphragm pump known from DE 10 2008 035 592 B4 is that air remains in at least the upper pump chambers of the diaphragm pump.

SUMMARY

It is therefore an object of the present invention to improve the known diaphragm pumps with regard to the residual emptying and/or the venting of the pumping chambers.

This object is achieved by the subject matter disclosed herein. Advantageous embodiments are set forth in the descriptions below.

The invention is based on the fundamental idea that the outlet opening of the outlet valve surrounds the inlet opening of the inlet valve or the inlet opening surrounds the outlet opening. By the outlet valve opening surrounding the inlet valve opening, there is the possibility that any air which may be present in the pump chamber can possibly flow into the outlet chamber from the pump chamber through the sections of the outlet valve opening provided above the inlet valve opening and is not captured in the upper region of the pump chamber as in the case of some diaphragm pumps of the prior art. Furthermore, by the outlet valve opening surrounding the inlet valve opening, there is also the possibility that the fluid to be pumped which is present in the lower region of a pump chamber can also flow into the outlet chamber through the region of the outlet opening provided below the inlet opening and thus a good residual emptying is achieved. For the diaphragm pump according to the invention, the possibility therefore arises that the diaphragm pump is, in particular, self-draining and/or -deaerating to the greatest possible extent. In addition to an improved flow distribution, a small frame size is made possible, which makes it possible to significantly reduce the quantity of the fluid to be pumped in the diaphragm pump. Furthermore, it is possible that both the outlet chamber and the inlet chamber can be arranged centrically. Together with an outlet channel arranged in the lower region in a preferred embodiment, both the inlet chamber and the outlet chamber can now be virtually completely emptied.

According to the invention, the diaphragm pump has one pump chamber, preferably two, and particularly preferably three, four or more pump chambers. Said pump chamber can be changed in terms of its volume, in particular preferably cyclically, in particular periodically by an external force. Particularly preferably, at least one wall of the chamber volume is formed by a diaphragm which is preferably made of an elastic material, for example plastic, rubber, elastomer, silicone or an equivalent material, which may also comprise composite materials for increased stability and durability. When the wall formed by the diaphragm is implemented so that it can completely squeeze off the space provided for the formation of the pump chamber, the pump chamber can be dimensioned with respect to the maximum volume of the pump chamber to be kept such that this maximum volume corresponds exactly to the fluid volume to be conveyed as planned within one pump stroke. Conceivably, even substantially larger pumping chambers can be provided which, for example, improve the flow behavior, the efficiency of the diaphragm pump or the production costs.

A pump chamber has at least one inlet and at least one outlet valve. The inlet valve has an inlet opening which can be closed by an inlet valve body, and the outlet valve has an outlet opening which can be closed by an outlet valve body. The respective valve body can be formed, in particular, by an elastic diaphragm which typically at least partially releases the valve opening associated with the valve body when a pressure differential is suitably applied. As materials for the valve body, for example, metals are also possible, but in particular also plastic, rubber, elastomer, silicone or an equivalent material is conceivable, which in particular also includes composite materials. When the applied pressure differential is in the opposite direction, the valve body closes the valve opening and/or a spring element is provided which acts on the valve body and biases the valve body into the closing position in the case of positions outside the closing position in which the valve body closes the valve opening. A diaphragm is here understood to mean, in particular, a preferably planar plate, which usually has elastic and/or resilient properties, even if only in sections, for example by a flexible edge section. Furthermore, a valve control can control the opening and closing of the valves or have an effect on the optimization of the pumping process.

According to the invention, the outlet opening surrounds the inlet opening or the inlet opening surrounds the outlet opening. The invention thus departs from the solutions known from the prior art in which the inlet opening and the outlet opening are arranged side by side, for example one above the other.

Particularly preferably, the inlet valve and/or the outlet valve is a screen valve. A screen valve is understood to mean a valve in which the valve body is formed by a screen.

An inlet chamber functions to make a fluid available. The inlet opening can be formed directly in a wall of the inlet chamber. This enables a compact construction of the diaphragm pump, in particular if, in a further preferred embodiment, the inlet opening opens directly into the pump chamber. In a preferred embodiment, however, an inlet channel is provided between the inlet chamber and the pump chamber, which inlet channel connects the inlet chamber to the pump chamber. This makes it possible to design the position of the inlet chamber within the diaphragm pump relative to the pump chamber more freely.

An outlet chamber serves for collecting and bundling the conveyed fluid, in particular for transfer into a central outlet of the diaphragm pump, in particular in the case multiple pump chambers and/or outlet valves. The outlet opening can be formed directly in a wall of the outlet chamber. As a result, a compact construction of the diaphragm pump is possible, in particular when, in a further preferred embodiment, the outlet opening opens directly into the pump chamber. In a preferred embodiment, however, an outlet channel is provided between the outlet chamber and the pump chamber, which outlet channel connects the outlet chamber to the pump chamber. This makes it possible to design the position of the outlet chamber within the diaphragm pump relative to the pump chamber more freely.

In the alternative of the invention, in which the outlet opening surrounds the inlet opening, preferred embodiments are conceivable in which the outlet opening is formed by a single annular opening. By "annular" is meant that a section of the opening is provided in each radial direction from a center, which is surrounded by the opening. The term "annular" is not limited to the description of circular ring-shaped openings. The shape of the open space forming the opening is defined in particular by the shape of the walls delimiting the free space. In the case of a circular ring-shaped opening, the opening is, for example, delimited by a first circular-ring-shaped wall and a second circular-ring-shaped wall arranged opposite the first circular-ring-shaped wall. It can be seen here that the shape of the free space forming the opening is delimited by an outer wall viewed from a center point, which is surrounded by the opening, in the radial direction, and an inner wall. In a preferred embodiment, the outer wall and the inner wall have the same geometrical shape. Particularly preferably, the inner wall and the outer wall are implemented concentrically to one another. For example, both the outer wall and the inner wall are the walls of a circle, an ellipse, a rectangle, in particular a square or a triangle. Particularly preferably, the distance between the inner wall and the outer wall is constant at every point in the circumferential direction of the outlet opening. This is particularly appropriate when the outer wall and the inner wall have the same geometrical shape. However, embodiments are also conceivable in which the distance between the inner wall and the outer wall is not constant at any point in the circumferential direction of the outlet opening. It can offer advantages to choose the distance between the inner wall and the outer wall to be larger in the upper region and/or in the lower region of the outlet opening than in lateral regions in order to provide more room to the fluid flowing through the outlet opening particularly in the upper and/or lower region. This can be achieved, in particular, by the fact that, in a preferred embodiment, the outer wall and the inner wall do not have the same geometrical shape or have the same geometrical shape, but are not implemented concentrically.

In the alternative of the invention in which the outlet opening surrounds the inlet opening, in a preferred embodiment the outlet opening of the outlet valve is formed by at least two outlet opening sections, which are separate from one another, surrounding the inlet opening. For the purposes of the present description, the term "outlet opening" thus does not describe a single opening, but is also used as a substitute for a sum of individual openings which are separated from one another. According to a preferred embodiment, the outlet opening is segmented into multiple outlet opening sections. The outlet opening sections are particularly preferably arranged ring-like around the inlet opening. For example, the outlet opening can be formed by an arcuate outlet opening section above the inlet opening and/or an arcuate outlet opening section below the inlet opening, while in a particularly preferred embodiment, no outlet opening sections are provided sideways of the inlet opening. The association of the outlet opening section to an outlet valve is achieved in a preferred embodiment in that the outlet opening section is closed by a common valve body.

In a preferred embodiment of the alternative of the invention in which the outlet opening surrounds the inlet opening the inlet opening is formed by a single opening not subdivided into outlet opening sections. However, it is also conceivable to form the inlet opening by inlet opening sections, which are arranged spatially within an envelope enclosing the outlet opening sections, for example, instead of a single circular inlet opening, a collection of adjacent circular inlet opening sections is provided.

In the alternative of the invention, in which the inlet opening surrounds the outlet opening, preferred embodiments are conceivable in which the inlet opening is formed by a single annular opening. By "annular" is meant that a section of the opening is provided in each radial direction from a center, which is surrounded by the opening. The term "annular" is not limited to the description of circular ring-shaped openings. The shape of the open space forming the opening is defined in particular by the shape of the walls delimiting the free space. In the case of a circular ring-shaped opening, the opening is, for example, delimited by a first circular-ring-shaped wall and a second circular-ring-shaped wall arranged opposite the first circular-ring-shaped wall. It can be seen here that the shape of the free space forming the opening is delimited by an outer wall viewed from a center point, which is surrounded by the opening, in the radial direction, and an inner wall. In a preferred embodiment, the outer wall and the inner wall have the same geometrical shape. Particularly preferably, the inner wall and the outer wall are implemented concentrically to one another. For example, both the outer wall and the inner wall are the walls of a circle, an ellipse, a rectangle, in particular a square or a triangle. Particularly preferably, the distance between the inner wall and the outer wall is constant at every point in the circumferential direction of the inlet opening. This is particularly appropriate when the outer wall and the inner wall have the same geometrical shape. However, embodiments are also conceivable in which the distance between the inner wall and the outer wall is not constant at any point in the circumferential direction of the inlet opening. It can offer advantages to choose the distance between the inner wall and the outer wall to be larger in the upper region and/or in the lower region of the inlet opening than in lateral regions in order to provide more room to the fluid flowing through the inlet opening particularly in the upper and/or lower region. This can be achieved, in particular, by the fact that, in a preferred embodiment, the outer wall and the inner wall do not have the same geometrical shape or have the same geometrical shape, but are not implemented concentrically.

In the alternative of the invention in which the inlet opening surrounds the outlet opening, in a preferred embodiment the inlet opening of the inlet valve is formed by at least two inlet opening sections, which are separate from one another, surrounding the inlet opening. For the purposes of the present description, the term "inlet opening" thus does not describe a single opening, but is also used as a substitute for a sum of individual openings which are separated from one another. According to a preferred embodiment, the inlet opening is segmented into multiple inlet opening sections. The inlet opening sections are particularly preferably arranged ring-like around the inlet opening. For example, the inlet opening can be formed by an arcuate inlet opening section above the outlet opening and/or an arcuate inlet opening section below the outlet opening, while in a particularly preferred embodiment, no inlet opening sections are provided sideways of the outlet opening. The association of the inlet opening section to an inlet valve is achieved in a preferred embodiment in that the inlet opening section is closed by a common valve body.

In a preferred embodiment, the alternative of the invention in which the inlet opening surrounds the outlet opening, the outlet opening is formed by a single opening which is not subdivided into outlet opening sections. However, it is also conceivable to form the outlet opening through outlet opening sections, which are arranged spatially within an envelope enclosing the inlet opening sections, for example, instead of a single circular outlet opening, a collection of adjacent circular outlet opening sections is provided.

According to a further preferred embodiment, the inlet chamber and the outlet chamber are implemented around a common central axis. The central axis is preferably formed by the longitudinal axis of the diaphragm pump. With this arrangement, the central axis particularly preferably passes through the inlet chamber and through the outlet chamber. Particularly preferably, a central arrangement of the inlet chamber or of the outlet chamber is provided, meaning that the outlet chamber or the inlet chamber have a shape that is implemented rotationally symmetrically about a point which is located on the central axis, or have a shape which is implemented point-symmetrically around a point which is located on the central axis or have a shape which is implemented mirror-symmetrically with respect to a plane which contains the central axis, wherein the central axis passes through a region of the outlet chamber and/or a region of the inlet chamber.

In an alternative embodiment, the inlet chamber is implemented around the central axis, the central axis passing through the inlet chamber, while the outlet chamber is implemented around the central axis such that the central axis does not pass through the outlet chamber, the outlet chamber being implemented annularly around the central axis. In this context, it is understood particularly preferably that both the outlet chamber and the inlet chamber have a shape which is implemented rotationally symmetrically about a point which is located on the central axis, or have a shape that is implemented point-symmetrically about a point which is located on the central axis, or have a shape which is implemented mirror-symmetrically with respect to a plane which contains the central axis, wherein the central axis passes only through a region of the inlet chamber but not through a region of the outlet chamber.

In an alternative embodiment, the outlet chamber is implemented around the central axis, the central axis passing through the outlet chamber while the inlet chamber is implemented around the central axis such that the central axis does not pass through the inlet chamber, the inlet chamber being implemented, for example, annularly around the central axis. In this context, it is understood particularly preferably that both the outlet chamber and the inlet chamber have a shape which is implemented rotationally symmetrically about a point which is located on the central axis, or have a shape that is implemented point-symmetrically about a point which is located on the central axis, or a have a shape which is implemented mirror-symmetrically with respect to a plane which contains the central axis, wherein the central axis only passes through a region of the outlet chamber but not through a region of the inlet chamber.

According to a preferred embodiment of the invention, the inlet chamber has a centrically arranged inlet channel. In an embodiment having multiple inlet valves, in a preferred embodiment, feed channels can branch off from this centrically arranged inlet channel to the individual inlet valves. In particular, a favorable flow distribution to the inlet valves is achieved by the centrical inlet channel.

According to an alternative embodiment, the inlet chamber has, on its vertically lower region, a wall which is formed in such a way that the wall is essentially flush with the lower part of the inlet opening of at least one inlet valve. In particular, one or more deepest inlet valves, with their respective lower region of their respective inlet opening, merge into the wall of the inlet chamber such that the inlet chamber can be completely emptied via the inlet valves and remaining fluid is pumped from the inlet chamber into the outlet chamber during the pumping process.

According to a preferred embodiment of the invention, the outlet chamber has a centrically arranged outlet channel. In one embodiment with multiple outlet valves, in a preferred embodiment, feed channels can lead to this centrally arranged outlet channel from the individual outlet valves.

According to an alternative embodiment, the outlet chamber has, on its vertically lower region, a wall which is formed in such a way that the wall is essentially flush with the lower part of the outlet opening of at least one outlet valve. In particular, one or more deepest outlet valves, with their respective lower region of their respective outlet opening, merge into the wall of the outlet chamber such that the outlet chamber can be completely emptied via the inlet valves and remaining fluid is pumped from the inlet chamber into the outlet chamber during the pumping process.

In a preferred embodiment, multiple pump chambers are present and preferably at least one inlet valve and/or at least one outlet valve are provided for each pump chamber.

In a preferred embodiment, all the outlet valves of the diaphragm pump are formed identically to one another and have, in particular, preferably the same shape as the outlet opening and/or the same shape of the valve body. In a preferred embodiment, all the inlet valves of the diaphragm pump are formed identically to one another and, in particular, preferably have the same shape as the inlet opening and/or the same shape as the valve body.

According to a preferred embodiment of the invention, one inlet valve is provided for each pump chamber. In a preferred embodiment, an inlet valve plate is provided, in which the inlet valves are arranged spatially separated. In a particularly preferred embodiment, the diaphragm pump has four pump chambers. In a preferred embodiment, the inlet valve plate then has four spatially separated inlet valves.

According to a preferred embodiment of the invention, one outlet valve is provided for each pump chamber. In a preferred embodiment, an outlet valve plate is provided, in which the outlet valves are arranged spatially separated. In a particularly preferred embodiment, the diaphragm pump has four pump chambers. In a preferred embodiment, the outlet valve plate then has four spatially separated inlet valves.

In a preferred embodiment, a valve plate is provided in which both the inlet valves and the outlet valves are implemented.

Particularly preferably, one of the outlet valves is arranged in the vertically lower region of the pump head or the valve plate corresponding to an outlet channel. This additionally promotes the emptying of the diaphragm pump.

According to a further preferred embodiment of the invention, both the number of outlet valves and the number of inlet valves correspond to the number of pump chambers. A number of four pump chambers with correspondingly four outlet valves in the valve plate and four inlet valves in the inlet valve plate have proven to be particularly favorable. In principle, however, it is also possible to associate, for example, two outlet and/or inlet valves, or multiple in each case, with each pump chamber.

According to a preferred embodiment of the invention, a valve plate having the pump chamber or the pump chambers and the outlet valve or the outlet valves and the inlet valve, or the inlet valves is arranged between a front plate having the inlet chamber and an intermediate plate having the outlet chamber, on the one side, and a diaphragm carrying part carrying the pump diaphragms, on the other side. For simple and inexpensive production, the valve plate can be formed essentially flat.

According to a further preferred embodiment, an inlet channel is provided between the inlet chamber and a pump chamber. In this case, the inlet valve associated with the pump chamber is preferably arranged in the inlet channel, in particular at the beginning or at the end of the inlet channel. In addition or alternatively, an outlet channel can be provided between the outlet chamber and a pump chamber. The outlet valve associated with the pump chamber is particularly preferably arranged in the outlet channel, in particular preferably at the beginning or at the end of the outlet channel.

According to a further preferred embodiment, the invention comprises a device for conveying fluids by means of a diaphragm pump according to the invention, wherein a pump head is provided with a drive chamber and a drive, the pump chamber being sealed off from the drive chamber by means of a pump diaphragm. In a preferred embodiment an associated pump element can enable the pump diaphragm to perform a periodically axial pumping motion.

BRIEF DESCRIPTION OF THE DRAWINGS

In the following, the invention is explained in more detail with reference to a drawing representing an exemplary embodiment of the invention. In the figures.

DETAILED DESCRIPTION

Figure 1:
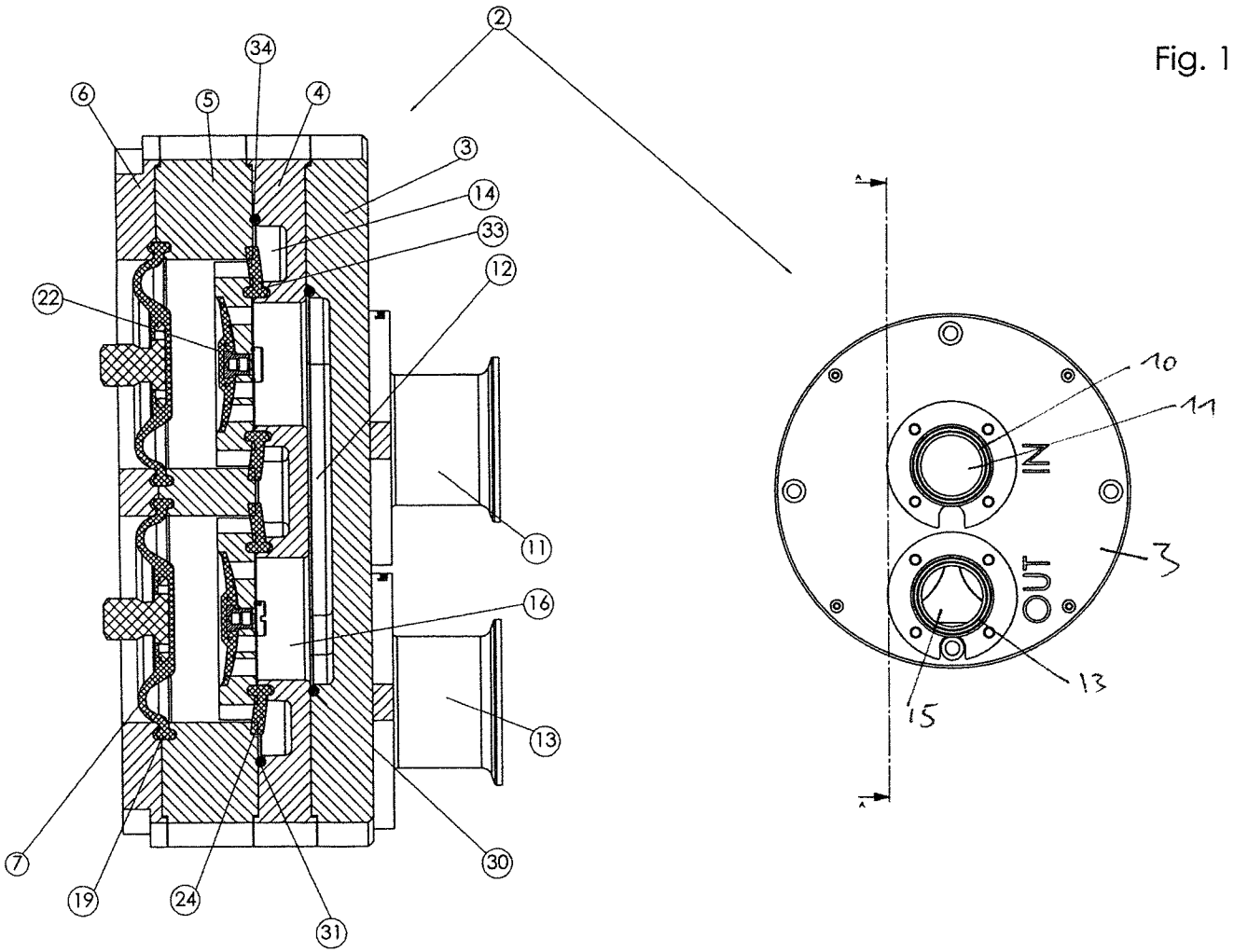
FIG. 1 shows a plan view of a pump head of a diaphragm pump (without drive) according to the invention, as well as a sectioned side view along the line A-A in plan view.

FIG. 1 shows the pump head 2 of a diaphragm pump 1. The diaphragm pump 1 forms part of the device shown in FIG. 6.

Figure 2:
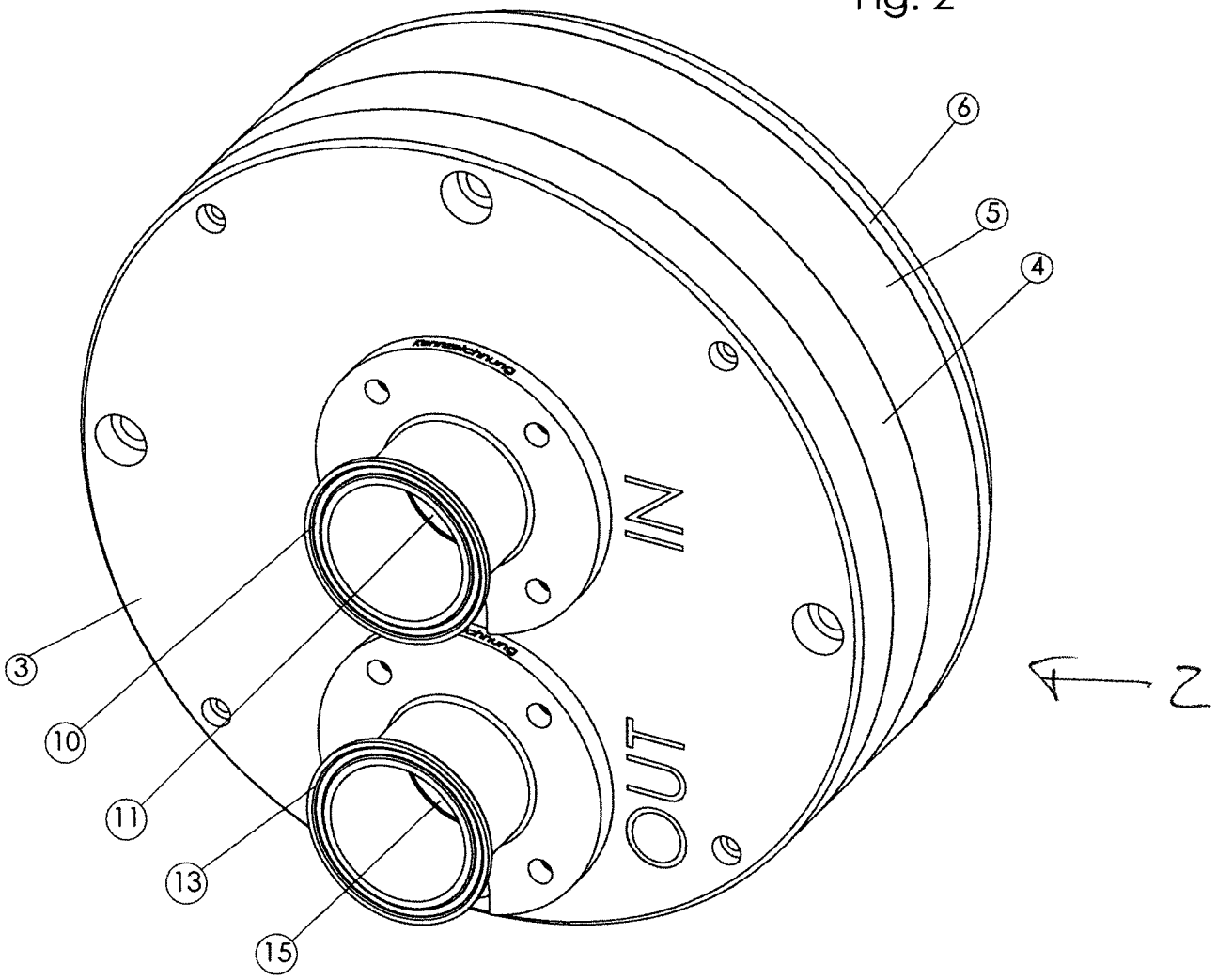
FIG. 2 shows a perspective front view of the pump head of FIG. 1 with a valve plate.

The pump head 2 has a front plate 3, an intermediate plate 4, also referred to as a chamber housing, a valve plate 5, and an end plate 6, also referred to as a diaphragm carrier, with pump diaphragms 7 which are connected to the wobble plate not shown in FIG. 2 via pump elements.

Provided on the front plate 3 is a central inlet 10, which opens into a central inlet chamber 12 via an inlet channel 11 formed in the front plate 3. An outlet 13 is provided on the front plate 3, which outlet is connected to a likewise central outlet chamber 14 of the intermediate plate 4 via an outlet channel 15 which is partly formed in the front plate 3 and partly in the intermediate plate 4.

The valve plate 5 is arranged between the intermediate plate 4 and the end plate 6. On its rear side 17 facing away from the intermediate plate 4, the valve plate 5 has four pump chambers 18. The pump chambers 18, which are open to the end plate 6, are each closed or delimited by a pump diaphragm 7. The pump diaphragms 7 are arranged between the end plate 6 and the valve plate 5. An annular bead 19 of the pump diaphragm 7 is arranged in a groove 20 of the valve plate 5 arranged around the pump chamber 18.

The intermediate plate 4 closes the inlet chamber 12 of the front plate 3, but in each case has inlet channels 16 leading to inlet valves 22 which inlet channels pass through the outlet chamber 14 of the intermediate plate 4. The valve plate 5 has four inlet valves 22, which are formed as screen valves and which connect the inlet chamber 12 via the respective channels 16 to the pump chamber 18 associated with the respective inlet valve 22.

The valve plate 5 also seals the central outlet chamber 14 of the intermediate plate 4. The valve plate 5 is essentially flat and has four outlet valves 24, which correspond to the outlet chamber 14, which outlet valves are also formed as screen valves. The outlet opening of the outlet valve 24 is formed by outlet opening sections 23*a* of the respective outlet valve 24 which surround the inlet opening sections

23*b* of the inlet valve 22 associated with the respective same pump chamber 18 which inlet opening sections form the inlet opening of the inlet valve 22. The outlet opening sections 23*a* preferably directly adjoin the inlet opening sections 23*b* with the respective outlet opening sections 23*a* and the inlet opening sections 23*b* separated from each other by a bead or wall.

Figure 6:
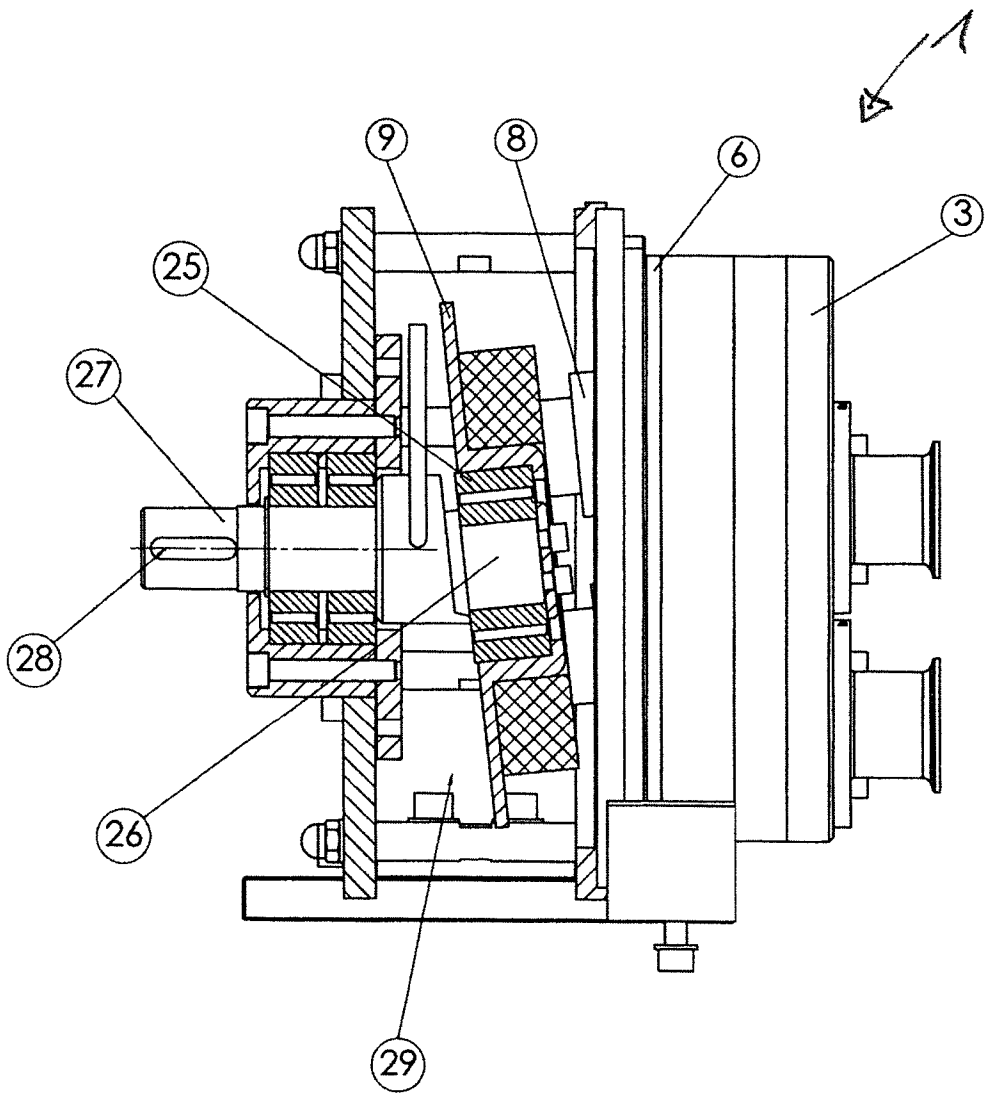
FIG. 6 shows a partial sectional view of a device with a diaphragm pump according to FIG. 1.

The wobble plate 9 shown in FIG. 6 is connected to a pin 26 of a drive shaft 27 via a ball bearing 25. The pin 26 is thereby inclined relative to the longitudinal axis 28 of the drive shaft 27 in order to produce a wobbling motion of the wobble plate 8. The connection between the drive axle and the wobble plate 8 is arranged in the region of a drive chamber 29 arranged upstream of the end plate 6.

The inlet chamber 12 is sealed off from the intermediate plate 4 by a seal 30, which in the example is formed as a cord ring seal. The outer delimitation of the outlet chamber 14 is sealed by a seal 31, which is also formed as a cord ring seal in the example. The outlet openings 23*a* of the valve plate 5 are also sealed to the inlet channels 16 of the intermediate plate 4 by beads 34 arranged in a groove 33 at the screen-like valve body of the outlet valve 24.

As a result of the rotation of the drive shaft 27 about its longitudinal axis 28, the wobble plate 8 is enabled to perform a circumferential wobbling motion due to the inclination of the pin 26 without co-rotating with the drive shaft 27. As a result of the wobble motion of the wobble plate 8, the pump diaphragms 7 are enabled to perform a periodically axial pumping motion by which in the pumping chambers 18 alternately negative pressure is generated in the intake stroke by a motion in the direction of the drive chamber 29 and positive pressure is generated in the discharge stroke by a motion in the direction of the front plate 3.

Due to the respective downstream arrangement of the valve screen of the inlet valve 22, the inlet valve 22 opens and the corresponding outlet valve 24 closes automatically when there is negative pressure in the associated pump chamber 18. In the event of a positive pressure in the pump chamber 18, the associated inlet valve 22 closes and the corresponding outlet valve 24 opens automatically. As a result, the pumping medium is conveyed out of the pump chamber 18 through the outlet chamber 14 to the outlet 13.

FIG. 2 shows a perspective front view of the pump head of FIG. 1 with a valve plate. The sequence of the components front plate 3, intermediate plate 4, valve plate 5 and end plate 6 can be seen in this perspective view.

Figure 3:
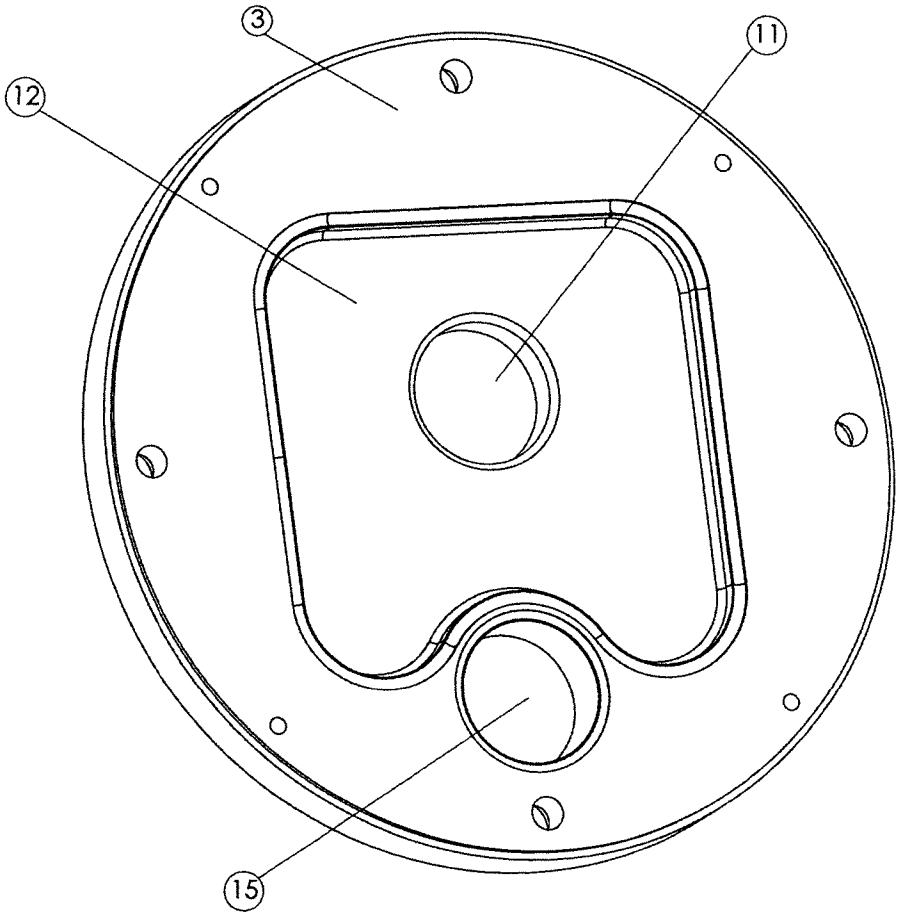
FIG. 3 shows both a front view and a rear view of a front plate of the pump head according to the invention of FIG. 1.
Figure 3:
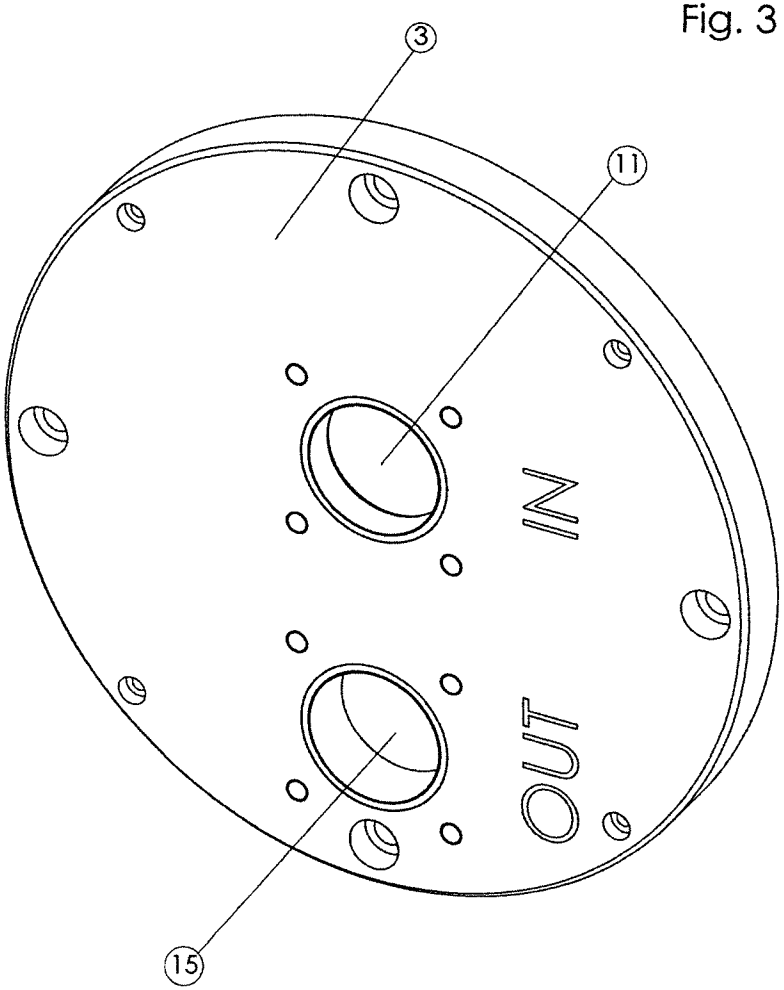

FIG. 3 shows both a front view and a rear view of the front plate 3 of the pump head according to the invention of FIG. 1. The inlet channel 11 as well as the outlet channel 15 and the inlet chamber 12 can also be clearly seen.

Figure 4:
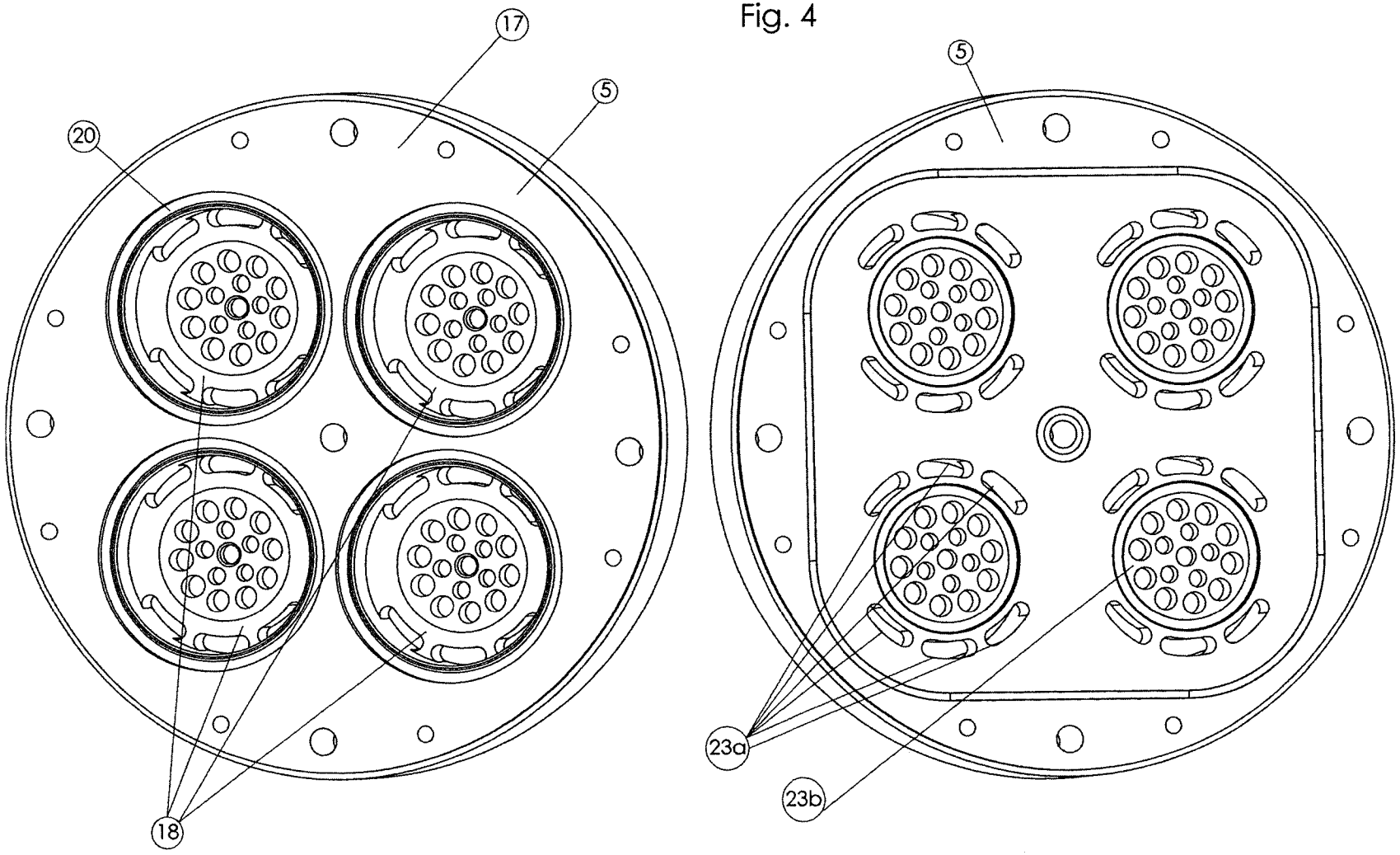
FIG. 4 shows both a front view and a rear view of a valve plate of the pump head according to the invention of FIG. 1.
Figure 5:
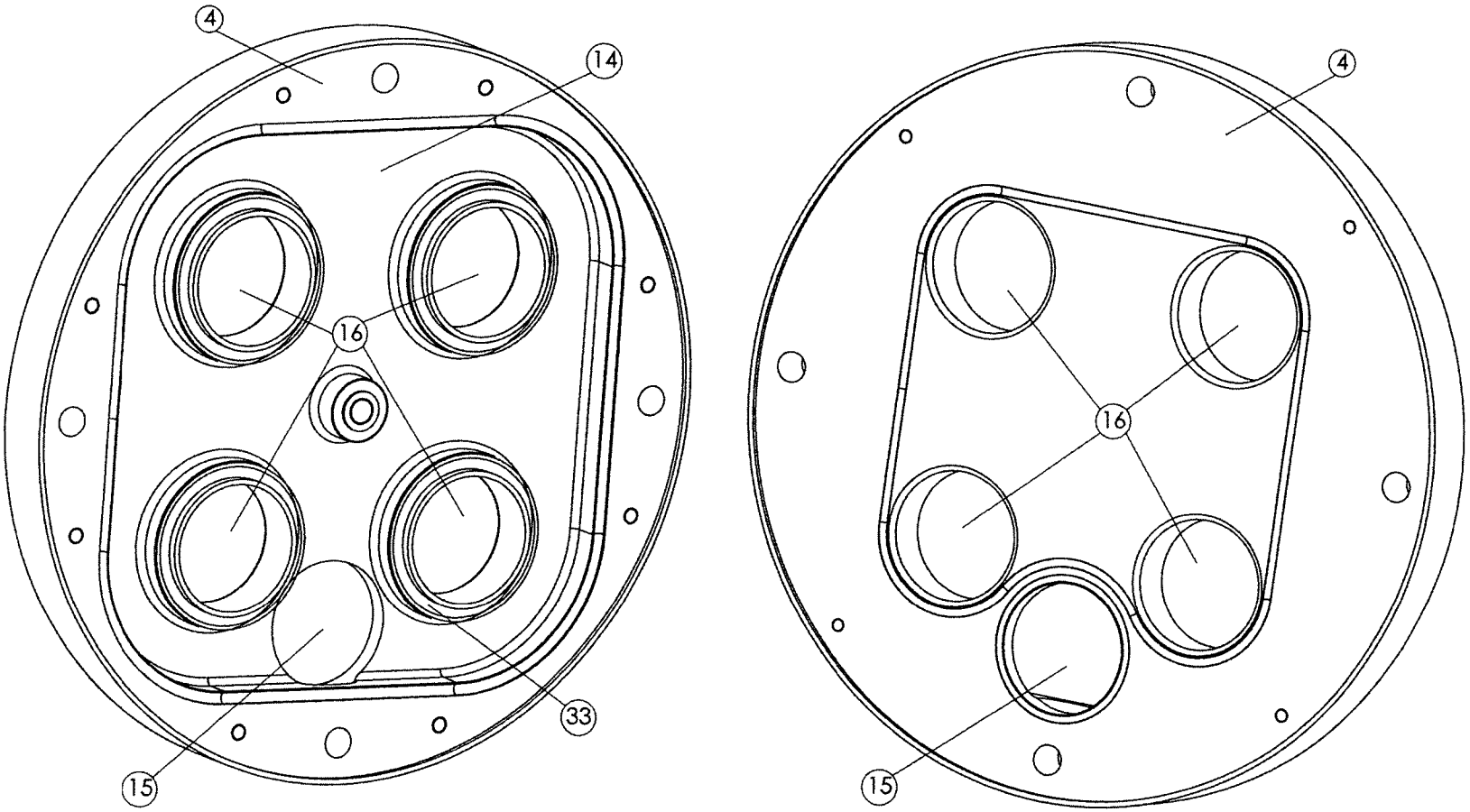
FIG. 5 shows both a front view and a rear view of an intermediate plate of the pump head according to the invention of FIG. 1.

FIG. 4 shows both a front view and a rear view of a valve plate 5 of the pump head according to the invention of FIG. 1. In these views, the annular outlet valves 24, the circular-segment-like outlet openings 23*a* and inlet openings 23*b* in the form of holes of the pump chamber 18, as well as the disc-like inlet valves 22.

The invention claimed is:

1. A pump head, having a body, having defined therein:

a plurality of pump chambers;

an outlet chamber in fluid communication with the plurality of pump chambers via a plurality of outlet openings in each of the plurality of pump chambers;

a plurality of outlet valves, each of the plurality of pump chambers including a corresponding one of the plurality of outlet valves for opening and closing a corresponding plurality of outlet openings in the corresponding pump chamber by the corresponding one of the plurality of outlet valves; and an inlet chamber in fluid communication with the plurality of pump chambers via one or more inlet openings in each of the plurality of pump chambers;

a plurality of inlet valves, each of the plurality of pump chambers including a corresponding one of the plurality of inlet valves for opening and closing a corresponding one or more of the one or more inlet openings in the corresponding pump chamber by the corresponding one of the plurality of inlet valves;

wherein:

the plurality of outlet openings of a corresponding pump chamber are arranged at least partially around the one or more inlet openings of the corresponding pump chamber such that, with reference to a vertical axis transverse to a longitudinal axis of the pump head, in each of the plurality of pump chambers, (i) at least a first outlet opening of the plurality of outlet openings is positioned above at least a corresponding one of the one or more inlet openings, whereby at least the first outlet opening deaerates residual air present in the corresponding pump chamber, and (ii) at least a second outlet opening of the plurality of outlet openings is positioned at a bottom of the corresponding pump chamber, and at least a corresponding one of the one or more inlet openings is positioned above at least the second outlet opening positioned at the bottom of the corresponding pump chamber, whereby at least the second outlet opening drains residual liquid present in the corresponding pump chamber;

wherein the plurality of pump chambers, the plurality of outlet openings, and the one or more inlet openings are defined in a valve plate of the pump head.

2. The pump head of claim 1, wherein the plurality of outlet openings comprise at least two outlet opening sections.

3. The pump head of claim 1, wherein the one or more inlet openings comprise at least two inlet opening sections.

4. The pump head of claim 1, wherein the inlet chamber and the outlet chamber have a common central axis.

5. The pump head of claim 1, wherein for each pump chamber a vertically lower region of the inlet chamber comprises a wall that is flush with a lower region of the one or more inlet openings of the corresponding pump chamber along or parallel to the longitudinal axis of the pump head.

6. The pump head of claim 1, wherein for each pump chamber a vertically lower region of the outlet chamber comprises a wall that is flush with a lower region of the plurality of outlet openings of the corresponding pump chamber along or parallel to the longitudinal axis of the pump head.

7. The pump head of claim 1, wherein the outlet chamber comprises a plurality of outlet chambers.

8. The pump head of claim 1, wherein the plurality of outlet valves are defined in the valve plate of the pump head.

9. The pump head of claim 7, wherein the plurality of pump chambers and the plurality of outlet valves are defined in the valve plate of the pump head, wherein a number of the plurality of outlet valves corresponds to a number of the plurality of pump chambers.

10. The pump head of claim 9, wherein the inlet chamber is defined in a front plate of the pump head, the plurality of outlet chambers are defined in an intermediate plate of the pump head, and a plurality of pump diaphragms are defined in an end plate of the pump head;

wherein the valve plate is arranged between the intermediate plate and the end plate.

11. The pump head of claim 10, further comprising a plurality of inlet channels defined in the intermediate plate of the pump head;

wherein each one of the plurality of inlet channels is arranged between the inlet chamber and a corresponding one of the plurality of pump chambers and wherein each one of the plurality of inlet channels is in fluid communication with the inlet chamber and the corresponding one of the plurality of pump chambers; and wherein each one of the plurality of inlet channels includes one of the plurality of inlet valves arranged in the one of the plurality of inlet channels at one of a first end and a second end of the one of the plurality of inlet channels.

12. The pump head of claim 11, further comprising a plurality of outlet channels defined in the valve plate of the pump head;

wherein each one of the plurality of outlet channels is arranged between a corresponding one of the plurality of outlet chambers and a corresponding one of the plurality of pump chambers and wherein each one of the plurality of outlet channels is in fluid communication with the corresponding one of the outlet chambers and the corresponding one of the plurality of pump chambers; and wherein each one of the plurality of outlet channels includes one of the plurality of outlet valves arranged in the one of the plurality of outlet channels at one of a first end and a second end of the one of the plurality of outlet channels.

13. The pump head of claim 11, wherein the plurality of pump chambers comprises four pump chambers, the plurality of outlet valves comprises four outlet valves, and the plurality of inlet valves comprises four inlet valves; and wherein an arrangement of the four inlet valves and the four outlet valves are defined in the valve plate.

14. The pump head of claim 1, wherein, for each pump chamber the plurality of outlet openings in the corresponding pump chamber that are arranged at least partially around the one or more inlet openings in the corresponding pump chamber, comprise an annular opening.

15. A diaphragm pump for conveying fluids, comprising:

a pump head having a body defining:

a plurality of pump chambers;

an outlet chamber in fluid communication with the plurality of pump chambers via a plurality of outlet openings in each of the plurality of pump chambers;

a plurality of outlet valves, each of the plurality of pump chambers including a corresponding one of the plurality of outlet valves for opening and closing a corresponding plurality plurality of outlet valves; and an inlet chamber in fluid communication with the plurality of pump chambers via one or more inlet openings in each of the plurality of pump chambers;

a plurality of inlet valves, each of the plurality of pump chambers including a corresponding one of the plurality of inlet valves for opening and closing a corresponding one or more of the one or more inlet openings in the corresponding pump chamber by the corresponding one of the plurality of inlet valves;

wherein:

the plurality of outlet openings of a corresponding pump chamber are arranged at least partially around the one or more inlet openings of the corresponding pump chamber such that, with reference to a vertical axis transverse to a longitudinal axis of the pump head, in each of the plurality of pump chambers, (i) at least a first outlet opening of the plurality of outlet openings is positioned above at least a corresponding one of the one or more inlet openings, whereby at least the first outlet opening deaerates residual air present in the corresponding pump chamber, and (ii) at least a second outlet opening of the plurality of outlet openings is positioned at a bottom of the corresponding pump chamber, and at least a corresponding one of the one or more inlet openings is positioned above at least the second outlet opening positioned at the bottom of the corresponding pump chamber, whereby at least the second outlet opening drains residual liquid present in the corresponding pump chamber;

wherein the plurality of pump chambers, the plurality of outlet openings, and the one or more inlet openings are defined in a valve plate of the pump head;

a drive body attached to the pump head, the drive body having defined therein a drive chamber arranged adjacent to the plurality of pump chambers;

a plurality of pump diaphragms, each pump diaphragm being arranged between the drive chamber and a corresponding one of the plurality of pump chambers, wherein each of the plurality of pump diaphragms is configured to seal the corresponding one of the plurality of pump chambers from the drive chamber; and a wobble plate within the drive chamber, wherein the wobble plate is configured to be connected to a drive shaft extending along the longitudinal axis of the pump head, and wherein wobble motion of the wobble plate causes each of the plurality of pump diaphragms to perform a periodically axial pumping motion.

16. The diaphragm pump of claim 15, wherein the plurality of outlet openings and the one or more inlet openings defined in the pump head are substantially coplanar, and wherein the pump head further comprises a seal which prevents fluid communication between the plurality of outlet openings and the one or more inlet openings.

17. The diaphragm pump of claim 15, wherein the wobble plate is connected by a pin to the drive shaft;

wherein the pin is inclined relative to the longitudinal axis of the drive shaft to cause the wobble plate to perform a circumferential wobbling motion.

18. A device comprising:

a pump head, having a body, having defined therein:

a plurality of pump chambers;

an outlet chamber arranged proximate to the plurality of pump chambers, the outlet chamber including a plurality of outlet openings arranged to open into the plurality of pump chambers;

a plurality of outlet valves, each of the plurality of pump chambers Including a corresponding one of the plurality of outlet valves arranged on a corresponding plurality of outlet openings and configured to open and dose the corresponding plurality of outlet openings to control fluid communication between the outlet chamber and a corresponding one of the plurality of pump chambers;

an inlet chamber arranged proximate to the plurality of pump chambers, the inlet chamber including one or more inlet openings arranged to open into the plurality of pump chambers; and a plurality of inlet valves arranged on the one or more inlet openings, each of the plurality of pump chambers including a corresponding one of the plurality of inlet valves which is configured to open and close a corresponding one or more inlet openings to control fluid communication between the inlet chamber and a corresponding one of the plurality of pump chambers;

wherein the plurality of outlet openings and the one or more inlet openings have a common central axis, and wherein:

the plurality of outlet openings of a corresponding pump chamber are arranged at least partially around the one or more inlet openings of the corresponding pump chamber such that, with reference to a vertical axis transverse to a longitudinal axis of the pump head, in each of the plurality of pump chambers, (i) at least a first outlet opening of the plurality of outlet openings is positioned above at least a corresponding one of the one or more inlet openings, whereby at least the first outlet opening deaerates residual air present in the corresponding pump chamber, and (ii) at least a second outlet opening of the plurality of outlet openings is positioned at a bottom of the corresponding pump chamber, and at least a corresponding one of the one or more inlet openings is positioned above at least the second outlet opening positioned at the bottom of the corresponding pump chamber, whereby at least the second outlet opening drains residual liquid present in the corresponding pump chamber;

wherein the plurality of pump chambers, the plurality of outlet openings, and the one or more inlet openings are defined in a valve plate of the pump head.

19. The device of claim 18, wherein the plurality of outlet openings comprises at least two outlet opening sections and wherein the one or more inlet openings comprises at least two inlet opening sections.

20. The device of claim 19, wherein the plurality of outlet openings and the one or more inlet openings are substantially coplanar, and wherein the pump head further comprises a seal which prevents fluid communication between the plurality of outlet openings and the one or more inlet openings.

21. The device of claim 18, further comprising:

a drive body attached to the pump head having defined therein a drive chamber arranged adjacent to the plurality of pump chambers;

a plurality of pump diaphragms, each pump diaphragm being arranged between the drive chamber and a corresponding one of the plurality of pump chambers and configured to seal the corresponding one of the plurality of pump chambers from the drive chamber; and a wobble plate within the drive chamber, the wobble plate being configured to be connected by a pin to a drive shaft extending along the longitudinal axis of the pump head, wherein the pin is inclined relative to the longitudinal axis of the drive shaft to cause the wobble plate to perform a circumferential wobbling motion when the drive shaft is rotated by a drive.

22. The pump head of claim 1, wherein the inlet chamber and the outlet chamber are oriented rotationally symmetrically about the longitudinal axis of the pump head.

* * * * *